United States Patent [19]

Dewing et al.

[11] 4,405,415

[45] Sep. 20, 1983

[54] ELECTROLYTIC REFINING OF MOLTEN METAL

[75] Inventors: Ernest W. Dewing; Adam J. Gesing, both of Kingston, Canada

[73] Assignee: Alcan International Limited, Montreal, Canada

[21] Appl. No.: 308,472

[22] Filed: Oct. 5, 1981

[30] Foreign Application Priority Data

Oct. 7, 1980 [GB] United Kingdom ..... 8032268

[51] Int. Cl.[3] ..... C25C 3/06; C25C 3/08; C25C 3/04

[52] U.S. Cl. ..... 204/67; 204/70; 204/243 R; 204/245; 204/268

[58] Field of Search ..... 204/67, 70, 243 R, 245, 204/268

[56] References Cited

U.S. PATENT DOCUMENTS 3,488,271 1/1970 Kummer et al. ..... 204/243 R
4,058,448 11/1977 Muzhzhavley et al. ..... 204/70
4,118,292 10/1978 Frey et al. ..... 204/64 T
4,334,975 6/1982 Ishizuka ..... 204/268
4,338,177 7/1982 Withers et al. ..... 204/245

*Primary Examiner*—Howard S. Williams
*Assistant Examiner*—Terryence F. Chapman
*Attorney, Agent, or Firm*—Cooper, Dunham, Clark, Griffin & Moran

[57] ABSTRACT

In a process for refining Al or Mg a stream of relatively impure molten metal is passed along one face of a grille separator having interstices of the order of 0.1–1 cm in width. The interstices are filled with a molten salt electrolyte adapted to transport ions of the selected metal (Al or Mg) to a body of refined metal on the opposite side of the separator. The relatively impure metal is made in the anode and the refined metal is the cathode. Refined metal is progressively withdrawn from the cathode. The grille separator may be arranged substantially vertical or substantially horizontal, usually with slight inclination. Passages are preferably provided in the separator to allow escape of gas generated at a metal/electrolyte interface.

22 Claims, 15 Drawing Figures

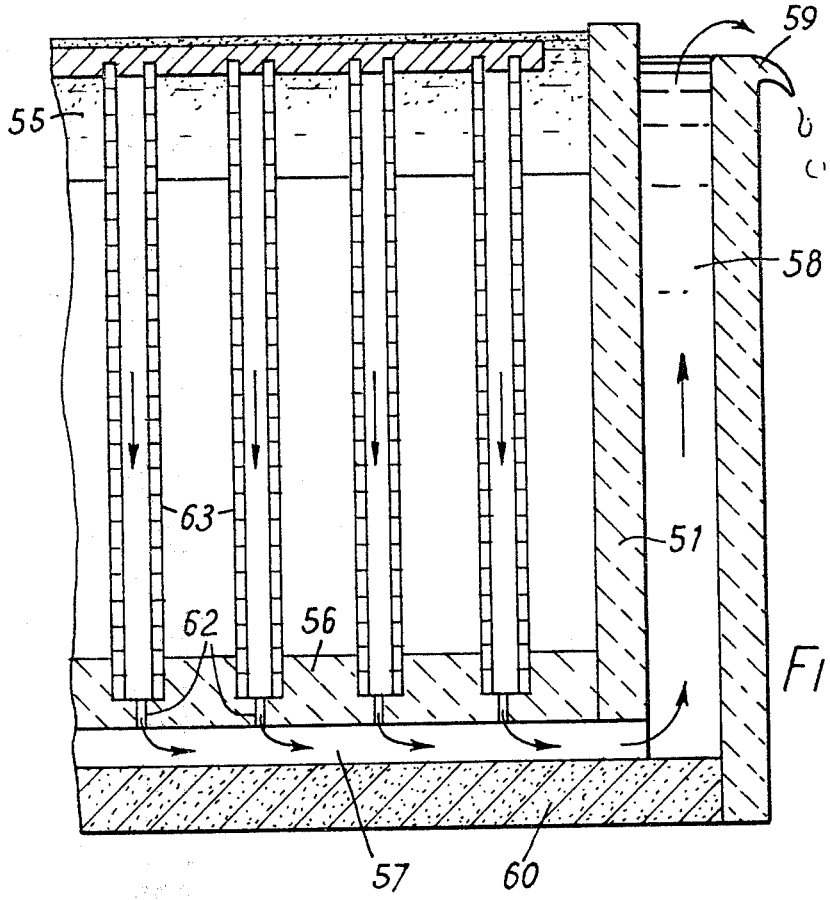
FIG. 13
FIG. 14
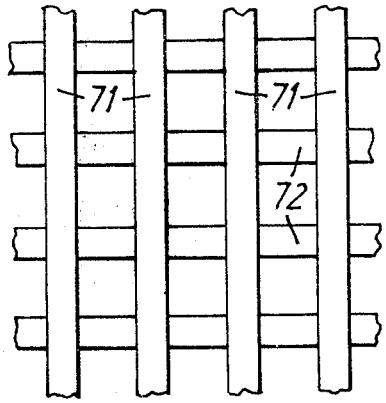
FIG. 15
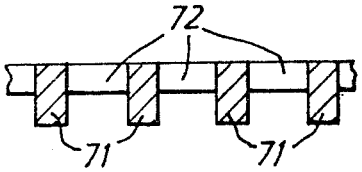

ELECTROLYTIC REFINING OF MOLTEN METAL

The present invention relates to a method and apparatus for the electrolytic refining of molten metal, especially for the recovery of aluminium or magnesium.

It has long been known to refine molten aluminium by an electrolytic refining technique in which a molten lower layer of a relatively high density aluminium alloy forms the anode of a cell and supports an intermediate layer of a fused electrolyte of intermediate density which in turn supports an upper layer of relatively low density, pure aluminium, which forms the cathode of the cell. The composition of the electrolyte, which must be capable of transporting $Al^{+++}$ ions from the anode to the cathode, is subject to the constraint of the requirement that its density be intermediate that of the heavy alloy anode layer and the pure aluminium cathode layer. It is also found necessary in practice that the thickness of the electrolyte layer be 10–25 cms. in order to prevent shorting between the anode and cathode layers as a result of the electromagnetic disturbances in the molten metal layers due to the high currents employed in the cell operation. In consequence it is found that the resistance of the cell is high because of the quite large anode/cathode distance and the comparatively high resistivity of electrolytes which have the correct density. The power requirements of the known process are thus high and the use of the process has been confined to the production of super-purity Al (99.99% purity) which commands a high premium in price over commercial purity Al metal.

It is clear that the cost of electrolytic refining of molten metals could be considerably reduced if the anode/cathode distance could be reduced and/or an electrolyte of low resistivity be employed.

It has already been proposed in U.S. Pat. No. 4,118,292 to effect electrolytic refining of molten metals by utilising a vertical porous diaphragm, which is permeable to molten electrolyte but not to molten metal, to separate an anode from a cathode, each of which is comprised of a packed bed of solid conductive particles, such as carbon, immersed in molten electrolyte. A stream of impure metal is passed through the anode structure and a stream of pure metal is passed through the cathode structure. Ions of the metal are transported from the impure metal through the electrolyte in the diaphragm to be taken up by the pure metal stream in contact with the cathode.

Although the proposals for the electrolytic refining of metals by use of a diaphragm cell are theoretically more efficient in use of electrical energy than the known three-layer process, the proposed diaphragms appear to be mechanically fragile and not adapted for use in a process intended to be carried out on a commercial scale and so far as is known such diaphragm cells have not to the present date been employed in commercial processes.

The present invention is based on observations of the interfacial tension of molten Al and molten electrolytes which led to the realisation that molten Al will not descend through an underlying column of molten electrolyte of substantially lower density and of a diameter of 0.5 cms. until there is a large static head (of the order of 30 cms.) of molten metal. From this observation it can be deduced according to the present invention that the intermediate electrolyte layer of the known three layer electrolytic refining process can be replaced by a non-conductive barrier in the form of a grille or the like, the interstices in the grille being filled with the electrolyte. Not only does this permit the anode/cathode distance to be greatly reduced (as compared with the three layer process) but it also removes the constraint imposed by the necessity of employing an electrolyte having a specific gravity above that of molten aluminium. It further has the advantage that the specific gravity of the lower anode layer of molten metal need no longer exceed that of the upper cathode layer. Indeed the lower layer could be less dense when desired. If convenient the relative positions of the cathode and anode layers may be reversed.

It is a further advantage of the separation of the molten metal anode and cathode layers by a grille or the like that one or both of such layers may be formed by a stream of molten metal flowing in a direction parallel to the grille. The grille separator of the present invention can thus be employed in a vertical arrangement to replace the vertical diaphragms of some forms of suggested diaphragm-type refining cells or in an essentially horizontal position to replace the intermediate layer of the three layer process. The advantage of the grille separator is that it can be mechanically strong while only a proportion of the anode/cathode space is occupied by the non-conducting material of the grille.

The grille itself may take many forms. Preferred forms are essentially honeycomb-type constructions with individual cells of hexagonal, rectangular or triangular section and having a minimum transverse dimension (width) in the range of 0.1–1 cm. Alternatively the grille may be formed of an array of unconnected parallel members at spacings of 0.1–1 cm. and this arrangement is particularly advantageous in one arrangement of apparatus to be described below.

As compared with the use of a porous diaphragm the use of large electrolyte-filled cells permits much greater local circulation of electrolyte and thus less risk of local polarisation. However it is greatly preferred that there should be intercommunication of the individual cells to ensure that the composition of the electrolyte in all the individual cells remains substantially the same in the course of operation and that there be no local fluctuations in hydrostatic pressure.

By reason of the removal of the operating constraints of the known three layer refining process and by reason of the much lower power requirements resulting from the reduced anode/cathode distance and the possibility of employing a less resistive electrolyte, the present invention opens the possibility of applying electrolytic refining on an economically viable commercial scale far more widely than was possible for the known three layer process. Particularly it permits any form of Al alloy to be treated directly to obtain a high purity Al without any preliminary conversion of the Al alloy to a high density Al-Cu alloy. Thus the use of this type of refining cell may render it possible to produce Al metal of acceptable impurity level on a commercial scale and cost from crude Al alloys obtained by the direct carbothermic reduction of alumina in the presence of other oxides. Thus the cell opens a possible route for the commerical production of Al by direct carbothermic reduction of refined alumina or naturally occurring kaolin, which has a substantial content of $SiO_2$ and other oxides in combined form.

For the recovery of Al from alloy scrap and for the extraction of Al metal from alloys obtained by the direct carbothermic reduction of alumina or aluminium silicate the present invention contemplates the passage of the alloy through a series of refining or extraction stages in the course of which the Al content of the alloy is progressively depleted. This may involve the use of different temperature and other operating conditions in different stages.

The performance of the process in this way is most conveniently achieved by directing the alloy downwardly along a serpentine path through a multi-polar cell structure, in which the cathode and anode layers in each electrolytic refining stage are respectively connected electrically to the anode and cathode layers of adjacent stages. Thus in this arrangement the refining stages are connected electrically in series so that a single D.C. power source of relatively high voltage may be employed for the whole multi-stage refining cell structure.

To prevent short circuiting in the multi-stage refining cell structure it is necessary to provide a discontinuity in the stream of alloy passing from one anode layer to the anode layer of the next stage. This is conveniently achieved by allowing the metal leaving the anode layer of one refining stage to flow downwardly through a body of the cell electrolyte, which provides a current path of much higher resistance than the current path from one anode layer to the next anode layer through the electrically conductive material (usually graphite), which physically separates and electrically connects each anode layer to the succeeding cathode layer, and through the electrolyte in the separator to the succeeding anode layer.

While the alloy preferably passes through the anode layers as a stream with an effective electrical discontinuity between each refining stage, the refined metal in the cathode layers is essentially static. However since each cathode layer is continuously receiving additional metal by transport through the electrolyte in the separator, the excess metal is drawn off in a similar fashion by passage through a body of electrolyte so as to avoid a connection via molten metal from one cathode layer to the next cathode layer.

In carrying out the process it is more or less inevitable that some moisture will be introduced into the system, with resultant liberation of hydrogen at the electrolyte/cathode interface.

The already mentioned arrangement of providing a separator grille in the form of an array of unconnected parallel members provides a particularly convenient means of overcoming this difficulty. Preferably the parallel grille-forming members are inclined at a small angle (1°–5°) to the horizontal and the space between the members communicates with an electrolyte-filled header, so that gas released at an electrolyte/metal interface migrates slowly to the header. This induces some circulatory movement of electrolyte in the cell space defined between adjacent grille-forming members and all these individual cells are interconnected to each other via the header. It may also be desirable (although usually unnecessary) to form lateral grooves in the grille-forming members to secure direct communication for movement of electrolyte between adjacent cell spaces.

The elimination of gas by passage through electrolyte contained between parallel rods can also be achieved by arranging the grille-forming rods in an essentially vertical plane, usually with the rods arranged vertically to form a pair of closely spaced grilles between which a cathode layer of purified metal is retained.

The parallel rods can conveniently be replaced by honeycomb material having rectangular cells, in which the webs defining the cells have a lesser depth (thickness) in one direction than in the other direction so that gas can leak upwards along the electrolyte/metal interface when the shallower webs are arranged transverse to the natural passage of gas. Such honeycomb material can be employed both in electrolyte-filled grille separators arranged in an essentially horizontal arrangement (inclined up to 5° to the horizontal) and in an essentially vertical arrangement.

As will readily be understood the honeycomb grille or individual members forming a grille separator used in the process of the present invention are preferably formed of a refractory material, which has a high resistivity (as compared with the electrolyte in the interstices) and is substantially unaffected by the molten metal present in the system.

Thus in a system for the recovery of aluminium from its alloys (including aluminium of ordinary commercial purity) the honeycomb grille or grille-forming separator rods is formed by material which is not wetted by molten aluminium and which is resistant to attack by molten aluminium. The grille (including separator rods) is preferably formed of alumina, aluminium nitride, aluminium oxynitride or sialon (silicon aluminium oxynitride).

The electrolyte employed in the process must wet the grille-forming material and be generally non-corrosive and chemically compatible with respect to the material of the grille separator. It should have a good electrical conductivity and a melting point below the melting point of the metal. It should also have a high dissolving power for a salt of the metal to be purified. In a system for the refining of aluminium the electrolyte preferably comprises a mixture of 1–70 mol.% aluminium chloride with appropriate quantities of one or more chlorides selected from the group comprised by the chlorides of Li, Na, K, Mg, Ca, Ba. In most instances the electrolyte will be composed of a mixture of sodium, barium and aluminium chlorides, probably with a small percentage of Li Cl (up to about 15 mol.%) to increase its conductivity. Barium chloride is preferably incorporated in such amounts as is required to raise the electrolyte density to a value approaching the density of molten aluminium. The electrolyte may also incorporate fluoride salts. When alumina is used for construction of the grille separator and the container, the proportion of fluoride is kept to a very low level, for example not more than about 5 mol% of the electrolyte, in order to avoid dissolution of the alumina. However when nitride-based ceramics are used as cell construction materials any proportion of fluoride salts is acceptable. Fluoride-based electrolytes have the advantage of being less volatile and less hygroscopic than their chloride equivalents.

The density of the molten electrolyte is preferably controlled to a value somewhat below the density of molten aluminium to permit a body of molten electrolyte to be maintained in the top of the apparatus above the molten product metal.

The electrical conductors in contact with molten aluminium in the cathode or anode of the system are preferably graphite or a so-called refractory hard metal, such as the borides or nitrides of titanium, zirconium, niobium or hafnium.

It is desirable that the process be operated at as low a temperature as possible consistent with maintaining the metal and electrolyte phases in the molten state for economy of electric power requirements, since in general the Faradaic current efficiency will deteriorate at higher temperature and the life of cell structural components will be reduced. For running without risk of local solidification of metal it is preferred to operate at a temperature somewhat above the melting point of Al, for example at about 680° C. or somewhat higher, when refining Al. While it is possible to operate at temperatures as low as 670° C. it is preferred to operate at a temperature in the range of 680°–800° C.

Almost the whole power input into the refining cell structure is converted to heat by resistance heating of the electrolyte in the anode/cathode space. When operating a multipolar cell with horizontal separators, the convenient route to remove the heat is by cooling the drops of impure alloy in transit between refining stages, by contact with cool electrolyte near the walls of the cell so that this metal acts as a means for withdrawing the heat generated in the interpolar space and transporting it to the side wall regions from where it is removed by conduction through the outside cell lining and the cooled steel shell. To avoid freezing, it is desirable that the melting point of the electrolyte is at least as low as and preferably substantially below that of the alloy subjected to the refining treatment.

While the invention has been described above in terms of its application to the recovery of refined Al from a relatively impure Al, the refining process of the invention is equally applicable to the refining of magnesium, using an electrolyte adapted to transport $Mg^{++}$ ions.

The invention was tested in a single stage laboratory apparatus without a free flow of crude Al alloy through the anode layer, employing a separator formed of square section alumina rods. The results obtained for the separation of high purity metal therefrom are set out in the following Examples 1–3. These test results establish the viability of the process of the invention. The very small voltage required across the single stage established the desirability of an apparatus incorporating a large number of refining stages connected electrically in series, so that the total cell voltage would be in the region of 5–10 volts D.C.

In the following tests the electrolyte employed was of lesser density than pure Al, so that the electrolyte of each Example could satisfactorily be employed in the multi-stage refining apparatus described below.

The rate of recovery of Al in the cathode layers indicate that a multi-stage refining cell designed for recovery of Al at the rate of 1–2 tonnes/day could be compact in design and consequently of low capital cost. The power requirements are modest in terms of recovery of Al metal and consequently the cost of an appropriate power source for the refining cell and the cost of electric power for operation are also modest.

EXAMPLE 1

Refining of Al 94.8%, Cu 5.2% alloy (containing 0.03% Fe, 0.01% Si)

Separator:
$Al_2O_3$ bars (5 × 5 mm), 4 mm spacing, 3.1 mm ACD (Anode/Cathode Distance)
Cathode Composition (wt. %)
Initial Cu 0.002, Fe 0.003, Si 0.001, Al remainder
Final Cu 0.003, Fe 0.013, Si 0.010, Al remainder
Initial Electrolyte Composition (mole %)
$CaCl_2$ 90, $AlF_3$ 10
Test Conditions:

EXAMPLE 1-continued

Refining of Al 94.8%, Cu 5.2% alloy (containing 0.03% Fe, 0.01% Si)

Temperature 800° C.
Duration 11.58 hours
Results

| | |
|---|---|
| Cell voltage | 380 mV |
| Electrolyte resistance drop | 290 mV |
| Concentration polarisation | 90 mV |
| Current density | 5.6 kA/m$^2$ |
| Cathode weight gain | 44.1 Kg/m$^2$ of separator/day |
| Current efficiency | 97% |
| Specific power consumption | 1.17 kWh/kg of Al |

EXAMPLE 2

Refining of Al 94.8%, Cu 5.2% alloy (containing 0.03% Fe, 0.01% Si)

Separator:
$Al_2O_3$ bars (5 × 5 mm), 4 mm spacing, 3.1 mm ACD
Cathode Composition (wt. %)
Initial Cu 0.002, Fe 0.003, Si 0.001, Al remainder
Final Cu 0.002, Fe 0.007, Si 0.04, Al remainder
Initial Electrolyte Composition (mole %)
NaCl 40, $CaCl_2$ 40, $AlF_3$ 10, $Na_3AlF_6$ 10
Test Conditions:
Temperature 750° C.
Duration 4.6 hours
Results

| | |
|---|---|
| Cell voltage | 275 mV |
| Electrolyte resistance drop | 223 mV |
| Concentration polarisation | 52 mV |
| Current density | 5.6 kA/m$^2$ |
| Cathode weight gain | 45.7 kg/m$^2$ of separator/day |
| Current efficiency | 100% |
| Specific power consumption | 0.815 kWh/kg of Al |

EXAMPLE 3

Refining of Al 95%, Fe 2.5%, Si 2.5% alloy.

Separator:
$Al_2O_3$ bars (5 × 5 mm), 4 mm spacing, 3.1 mm ACD
Cathode Composition (wt. %)
Initial Cu 0.002, Fe 0.003, Si 0.001, Al remainder
Final Cu 0.002, Fe 0.007, Si 0.04, Al remainder
Initial Electrolyte Compostion (mole %)
NaCl 42,5, $CaCl_2$ 42.5, $AlF_3$ 15
Test Conditions:
Temperature 780° C.
Duration 16.5 hours
Results

| | |
|---|---|
| Cell voltage | 250 mV |
| Electrolyte resistance drop | 200 mV |
| Concentration polarisation | 50 mV |
| Current density | 6.25 kA/m$^2$ |
| Cathode weight gain | 40.7 kg/m$^2$ of separator/day |
| Current efficiency | 87% |
| Specific power consumption | 0.85 kWh/kg of Al |

In further tests the electrolyte was essentially flouride-free to avoid possible problems arising from attack by flouride on alumina cell components in continuous operation.

EXAMPLE 4

Separator:
As in Examples 1–3, except for 2 mm spacing between bars

EXAMPLE 4-continued

| | |
|---|---|
| Anode metal | |
| Super purity Al metal (99.97 Al %) | |
| Cathode metal | |
| Super purity Al metal | |
| Electrolyte composition (mole %) | |
| 41% Al $Cl_3$ 59% NaCl | |
| Test Conditions: | |
| Temperature 694° C. | |
| Duration 21.27 hours | |
| Results | |
| Cell voltage | 420 mV |
| Electrolyte resistance drop | 270 mV |
| Concentration polarisation | 150 mV |
| Current density | 2.9 kA/$m^2$ |
| Cathode weight gain | 23.0 kg/$m^2$ of separator/day |
| Current efficiency | 99.7% |
| Specific power consumption | 1.26 kWh/kg of Al |

EXAMPLE 5

| | |
|---|---|
| Separator: | |
| As in Example 4 | |
| Anode Metal | |
| Si & Fe 0.95% | |
| Cu 0.05-0.2 | |
| Mn up to 0.05 | |
| Zn up to 0.10 | |
| Al balance | |
| Cathode Metal | |
| Al + impurities <0.05% | |
| Electrolyte Composition (mole %) | |
| 50% Al $Cl_3$ 50% NaCl | |
| Test Conditions: | |
| Temperature 692° C. | |
| Duration 21.25 hours | |
| Results | |
| Cell voltage | 390 mV |
| Electrolyte resistance drop | 230 mV |
| Concentration polarisation | 160 mV |
| Current density | 2.9 kA/$m^2$ |
| Cathode weight gain | 21.4 kg/$m^2$ of separator/day |
| Current efficiency | 92.8% |
| Specific power consumption | 1.25 kWh/kg of Al |

The invention is further illustrated diagrammatically in the accompanying drawings, in which:

FIG. 13 is a partial diagrammatic end view in a direction at right angles to the view of FIG. 11.

FIGS. 14 and 15 are respectively front and sectional views of a honeycomb material suitable for use as a grille separator in the refining cells of FIGS. 2-8 and of FIGS. 11-13.

Figure 1:
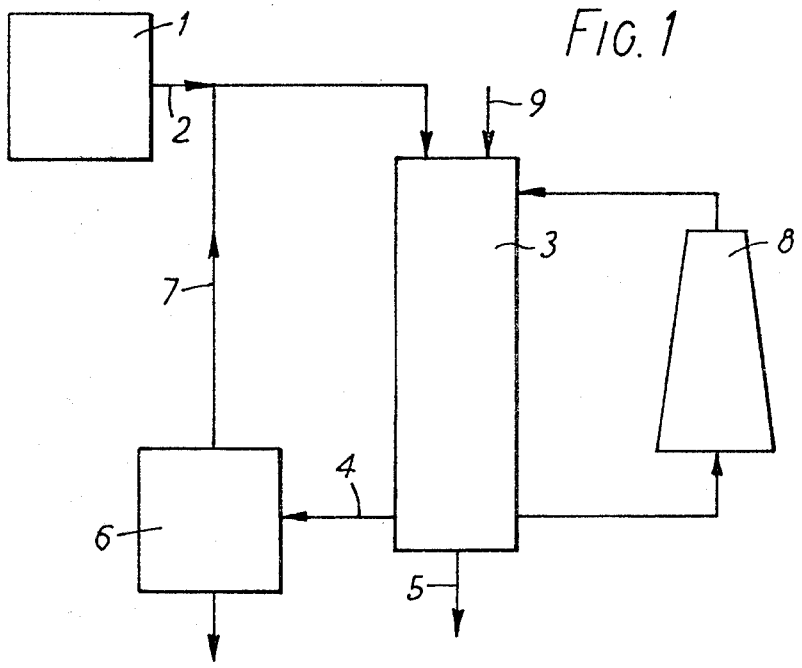
FIG. 1 is a diagram of a continuously operating system for the extraction of Al metal from an Al alloy.

Referring firstly to FIG. 1 the system comprises a furnace 1 to act as a source of supply of impure metal, connected by conduit 2 to the upper end of multi-stage refining cell 3, which has an outlet 4 for treated impure metal and an outlet 5 for extracted pure metal. The treated impure metal is forwarded to a crystallizer 6, in which the metal is cooled and filtered to remove precipitable intermetallic phases, the remaining molten metal being recycled via conduit 7 to conduit 2. The cell 3 is provided with a water jacket, through which a controlled stream of water is circulated and cooled in cooling tower 8. The cell is also provided with an outlet 9 to bleed off gas generated in the cell and to act as an inlet for make-up electrolyte to replace process loss.

Figure 2:
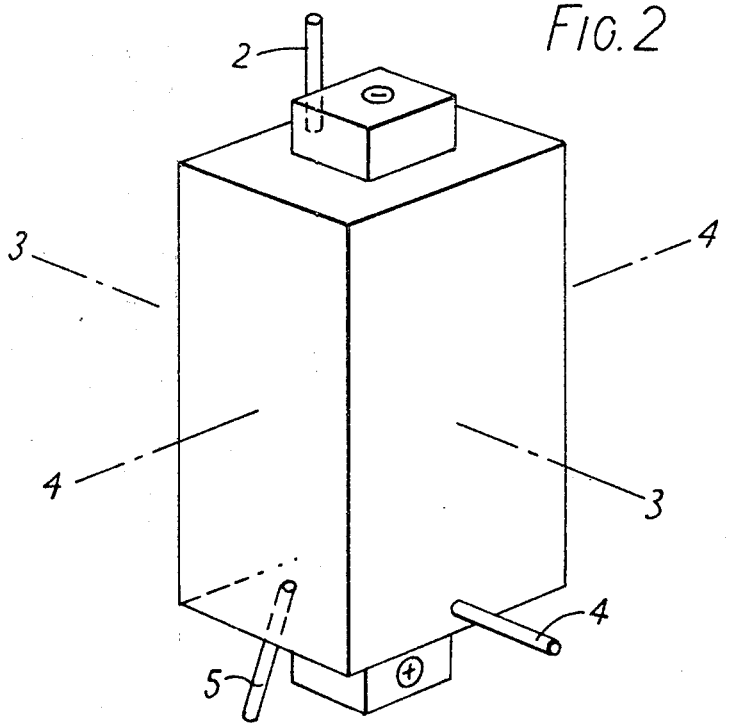
FIG. 2 is a diagram of a multi-stage refining cell in the system of FIG. 1.

As will be seen from FIG. 2, the cell 3 is a substantially upright structure having a carbon cathode at the upper end and an anode electrode at the bottom end.

The cell 3 comprises an outer shell 10 (the cooling jacket being omitted in FIGS. 3 and 4), which contains a body of molten electrolyte.

The shell 10 is lined with a mass of alumina refractory 10' (not shown in FIGS. 3 and 4) in which are formed vertical passages 11, 11' extending the full height of the assembly of refining stages in the shell. The passages 11, 11' are filled with electrolyte and communicate with each other. Vertical passage 11 forms a collector for the product aluminium and vertical passage 11' forms a header for the electrolyte in the grilles and a vertical gas escape passage.

The refining stages are comprised of a series of graphite trays 12, having passages 14, formed in their upper surface to form flow paths for the crude metal, separated by partitions 15, which act as supports for rectangular alumina rods 16, which are of a thickness of about 5 mm (in the vertical direction) and spaced apart by about 5 mm. The rods 16 are preferably inclined at a small angle of 1-5% to the horizontal. The partitions 15 of the trays 12 are shaped to allow this inclination while maintaining the bottoms of the passages 14 in a horizontal plane.

Figure 3:
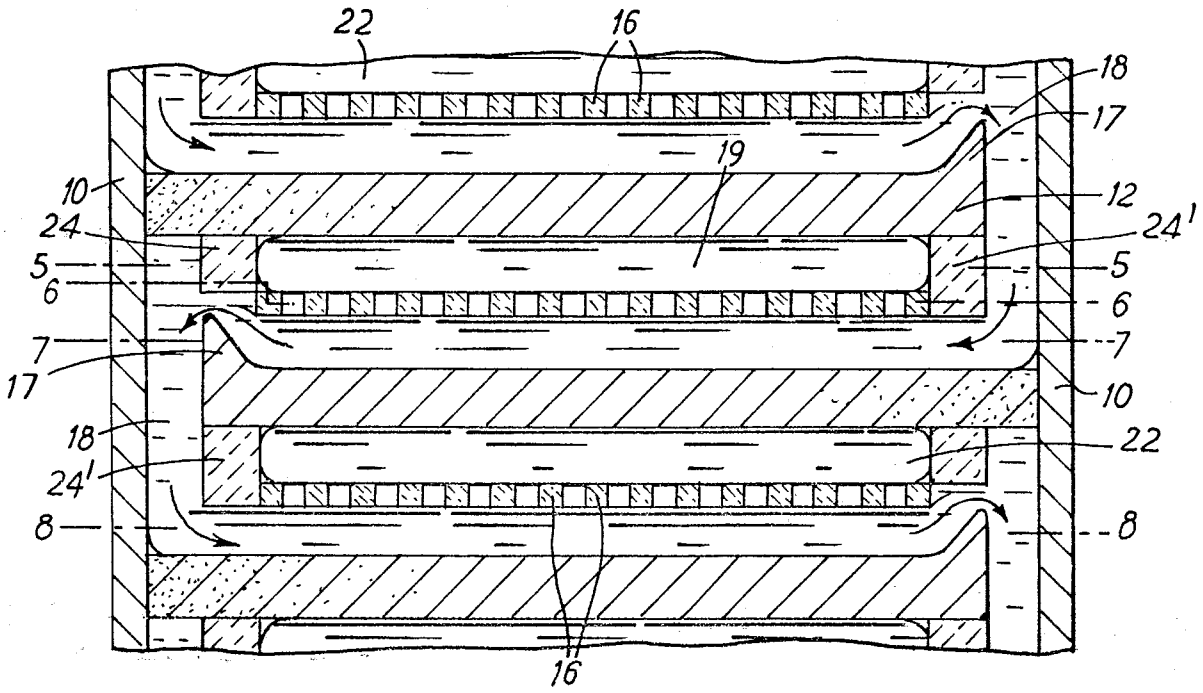
FIG. 3 is a part-vertical section on line 3—3 of FIG. 2.
Figure 4:
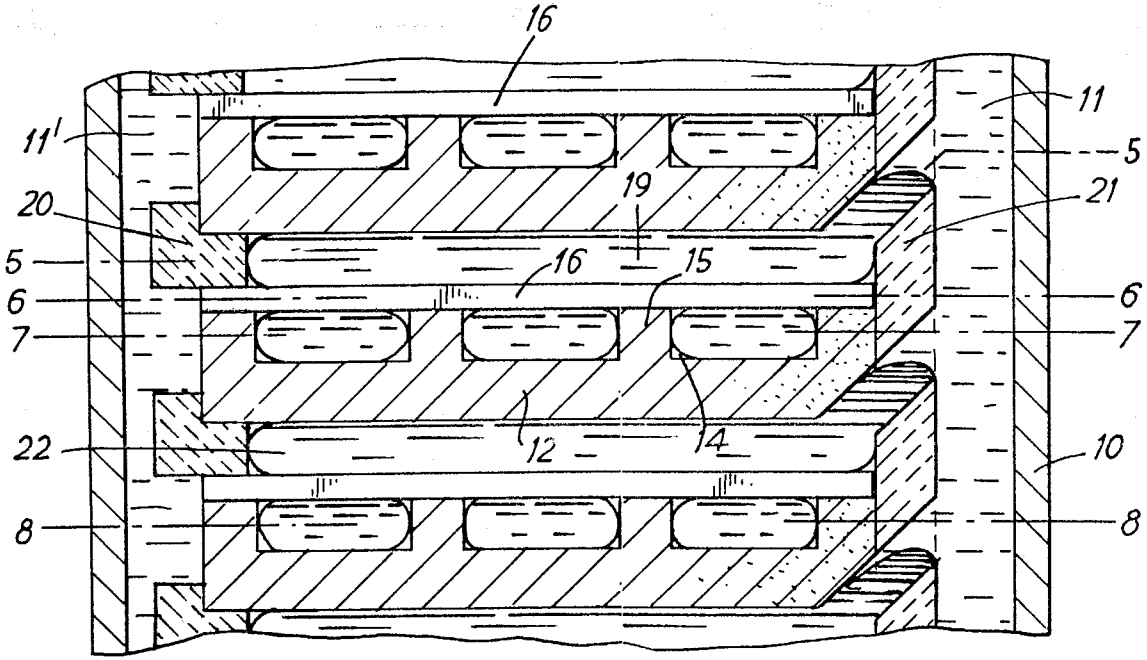
FIG. 4 is a part-vertical section on line 4—4 of FIG. 2.
Figure 5:
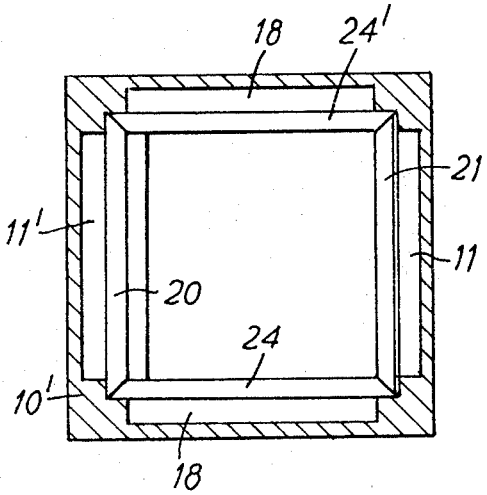
FIGS. 5-8 are near horizontal sections on lines 5—5, 6—6, 7—7 and 8—8 of FIG. 4 respectively.
Figure 6:
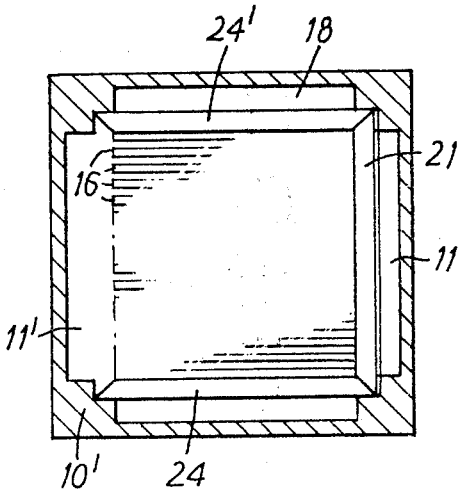
Figure 7:
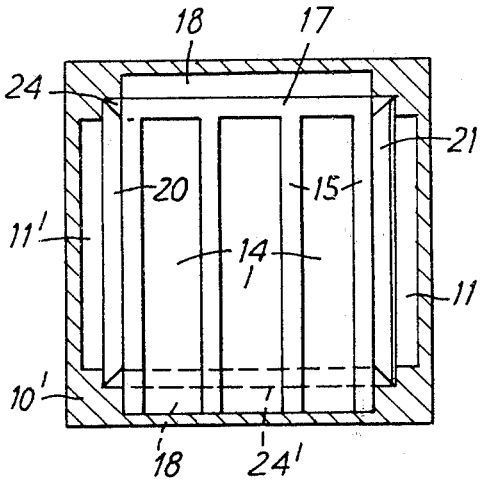
Figure 8:
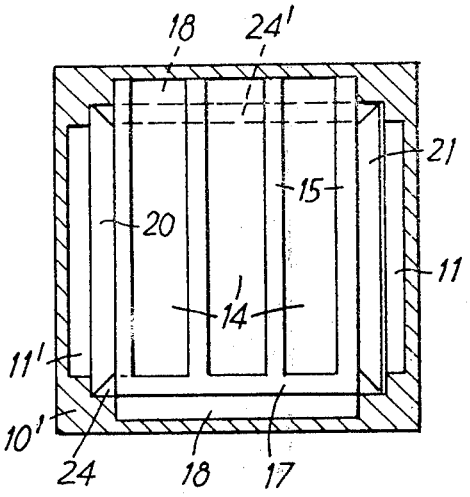

As will be seen in FIG. 3, a weir member 17, integral with the tray 12, is arranged at the outlet end of each crude metal passage 14 in a tray 12 to ensure that the crude metal is maintained in contact with electrolyte in the spaces between the rods 16. The crude metal, passing through the passages 14 and flowing over the weirs 17, follows an essentially serpentine path. The crude metal exiting from a refining stage descends through a vertical passage 18, which is filled with electrolyte and divided into separate electrolyte-filled spaces defined between alternate trays 14. Adjacent trays are longitudinally displaced from each other (in the direction of crude metal flow) so that the crude metal overflowing the weir 17 at the end of one tray falls in droplet form through the electrolyte in passage 18 to be collected at the entrance end of the horizontal passages 14 in the tray below.

Each of the electrolyte-filled spaces in the passages 18 are connected with passages 11, 11' by means of conduits (not shown) in the refractory lining 10'. The electrolyte in the spaces between alternate trays in passages 18 forms an effective electrical discontinuity between the crude metal flowing through the passages 14 in a tray 12 from the crude metal flowing through the passages 14 in the trays above and below it.

A space 19 is provided beneath each tray 12 to hold a body of relatively pure metal 22, forming the cathode layer of a refining stage. At the upper end of the separator formed by inclined rods 16, the space 19 is closed off by a non-conductive alumina cross member 20 while at the lower end a weir 21, also formed of alumina, is arranged at a height sufficient to ensure that the metal in space 19 maintains good contact with the overlying surface of the tray 12. The sides of the space occupied by the cathode metal is closed by non-conductive refractory members 24, 24'. The weir 21 allows the metal, accumulating in the cathode layer in space 19 by transport through the electrolyte in the separator, to spill over for descent through the electrolyte in passage 11 at the right hand side in FIG. 4 for tapping off from the bottom of the cell via outlet 5.

The graphite trays 12 constitute an electrical connection between the anode layer of one refining stage and the cathode layer of the next refining stage. The graphite tray at the bottom of the cell serves as the anode lead and the cathode lead may be formed by a graphite block having a recess in its lower surface to contain the uppermost cathode layer.

Figure 9:
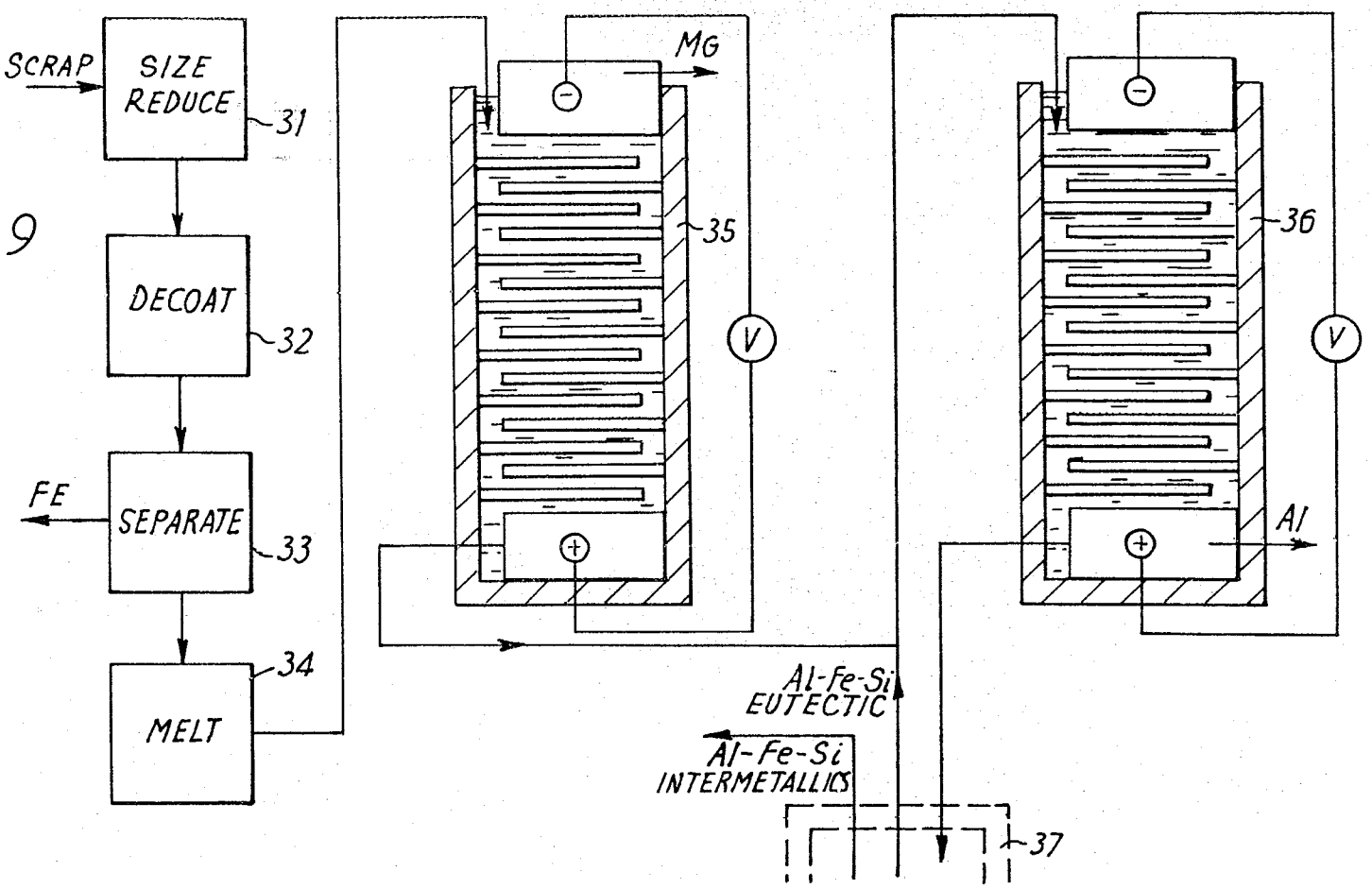
FIG. 9 is a diagram of a system for recovery of aluminium and magnesium from Al-Mg can stock scrap.

The system of FIG. 9 illustrates diagrammatically the recovery of Al and Mg from Al-Mg alloy can stock scrap. Since Mg is transported preferentially to Al in electrolytic refining, Mg is stripped off from the molten scrap in a first refining cell and aluminium is recovered from scrap in a second refining cell.

In FIG. 9 the Al-Mg alloy scrap, which usually becomes mixed by accident with other alloy scrap, usually having substantial contents of other common alloying elements such as Fe, Si, is first shredded in a size reduction stage 31. The shredded scrap, which is usually lacquered, is then decoated in stage 32, in which the lacquer is burnt off. It is then subjected to electromagnetic separation in stage 33 to remove any tin plate or other steel scrap which may have become mixed with the Al-Mg alloy scrap. The decoated scrap is then melted in stage 34 and is passed to a first electrolytic refining cell 35 which is essentially constructed in the same way as the multi-stage cell of FIGS. 2–8, modified to make it suitable for removal of Mg from the crude molten metal passed through it. Thus the cathode layers are formed of pure molten magnesium and the grille rods are formed of spinel, $MgAl_2O_4$, since alumina grille rods would be attacked by molten Mg. All other refractory parts, which come into contact with molten Mg, are also formed of spinel.

Electrolytes suitable for removal of Mg from Al-Mg alloys preferably comprise a mixture of magnesium chloride with one or more of the chlorides of Li, Na, K, Mg, Ca, Ba. In most instances the electrolyte will be composed of a mixture of sodium, barium and magnesium chloride. Similar electrolyte formulations are used for refining Mg-base alloys.

Since molten Mg is less dense than possible molten electrolytes the weirs at the outlets of the Mg cathode layers are inverted and the resultant underflow from the cathode layer floats upwards through molten electrolyte for collection at the top of the cell. The crude metal, leaving cell 35 after being stripped of its magnesium content is passed to a second refining cell 36, which is constructed in accordance with the cell of FIGS. 2–8. The Al content of the crude metal entering the top of cell 36 is reduced by about 85–90% during its passage through the cell and the underflow, exiting from the cell 36, is passed to a crystallizer 37, in which a large proportion of the Fe and Si content is deposited as Al-Fe-Si intermetallic and removed from the system. An Al-Fe-Si eutectic is recirculated in molten condition from crystallizer 37 to the inlet of cell 36.

Figure 10:
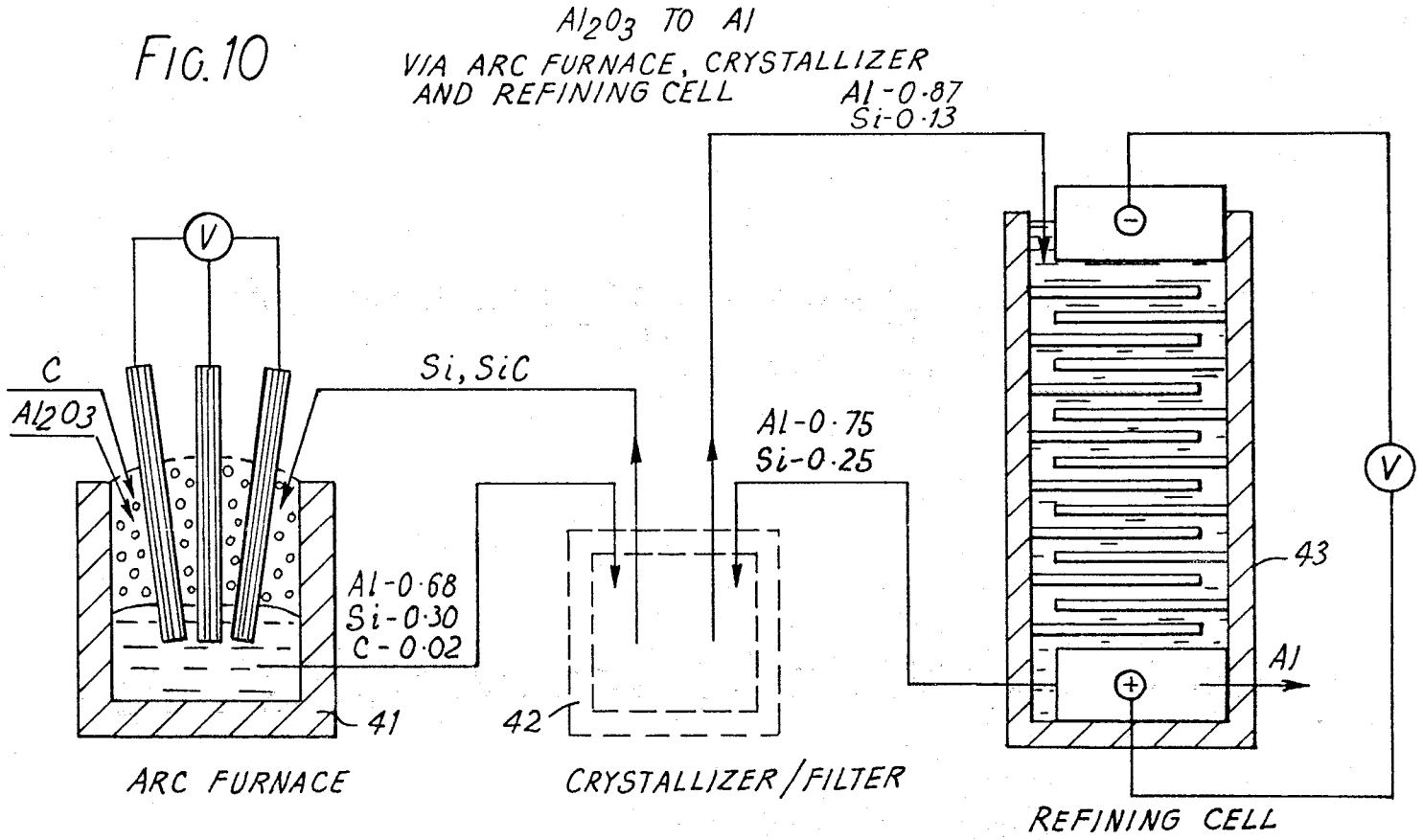
FIG. 10 is a diagram of a system for the production of aluminium metal by carbothermic reduction of alumina and electrolytic refining of the product.

FIG. 10 illustrates schematically a system for the production of metallic aluminium by a new route, employing the refining cell illustrated in FIGS. 2–8. It is already known to produce Al-Si eutectic alloys by carbothermic reduction of alumina in the presence of silicon. In the known method the product is a hyper-eutectic Al-Si alloy, from which excess Si is removed in a crystallizer and returned to the arc furnace in which the carbothermic reduction is performed and Al-Si eutectic is removed from the crystallizer in molten condition for casting into ingots. The alloy obtained from the arc furnace is essentially free from $Al_4C_3$ and aluminium oxycarbide.

The present scheme differs from the known method in that virtually the whole of the silicon content of the metal withdrawn from the arc furnace is returned to it.

In the arc furnace 41 the carbothermic reduction of alumina is performed by a submerged arc process. The charge to the furnace is C, $Al_2O_3$, with a small amount of $SiO_2$ make-up, as necessary, together with all the Si and SiC recovered in crystallizer 42, to which the product of the arc furnace process is supplied, typically at a composition by weight of 68% Al, 30% Si and 2% C (in the form of SiC). Molten Al-13% Si eutectic is drawn from the crystallizer and passed to the refining cell 43 (which may be one of a series of refining cells arranged in parallel). The eutectic Al-Si alloy is treated in cell 43 to recover aproximately half its Al content at the cathodes of the refining stages. The crude metal outflow from the cell is returned at a composition of Al 75%, Si 25% to the crystallizer 42.

The precise compositions of the arc furnace product and the crude metal returned to the crystallizer are not of particular significance.

Figure 11:
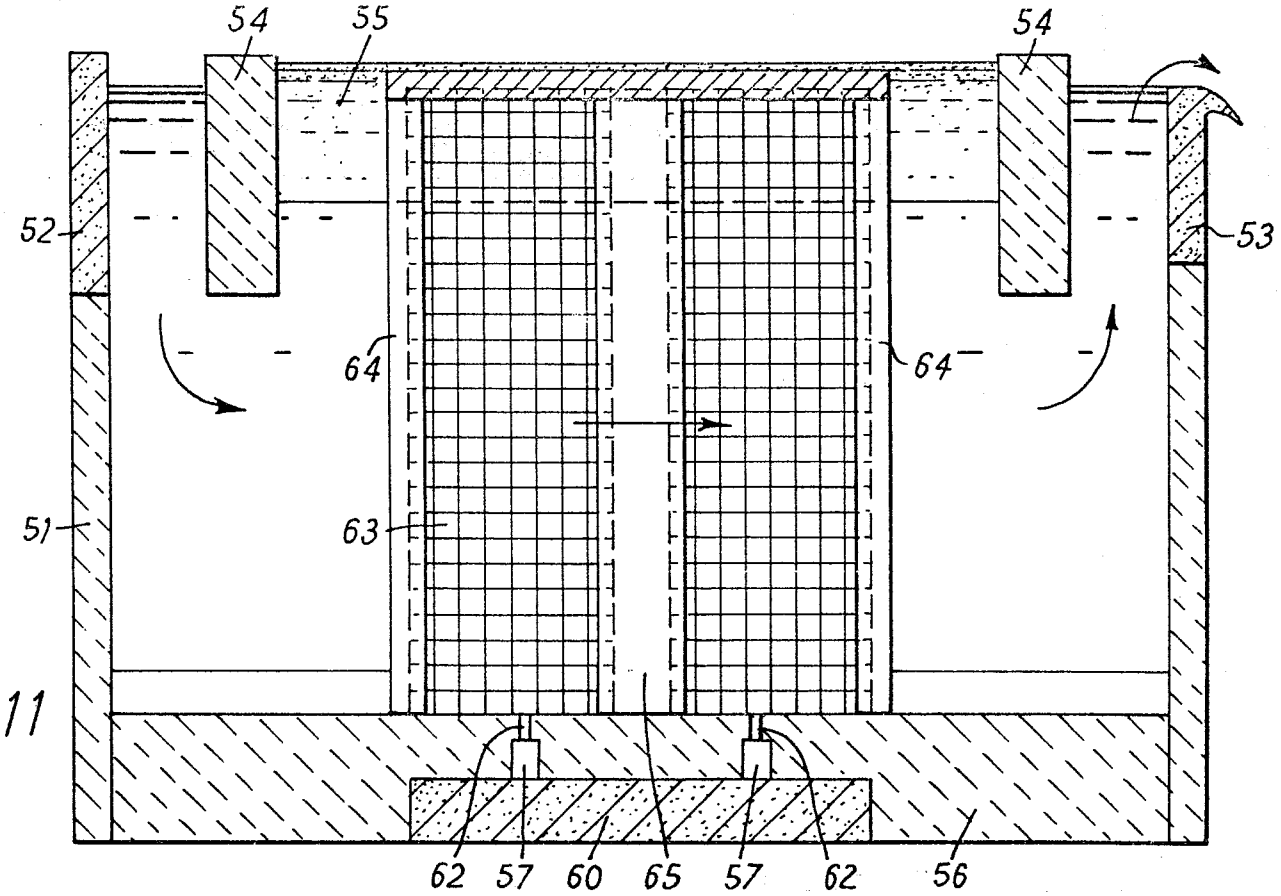
FIG. 11 is a diagrammatic side view of a single stage refining cell with vertical grille separators.
Figure 12:
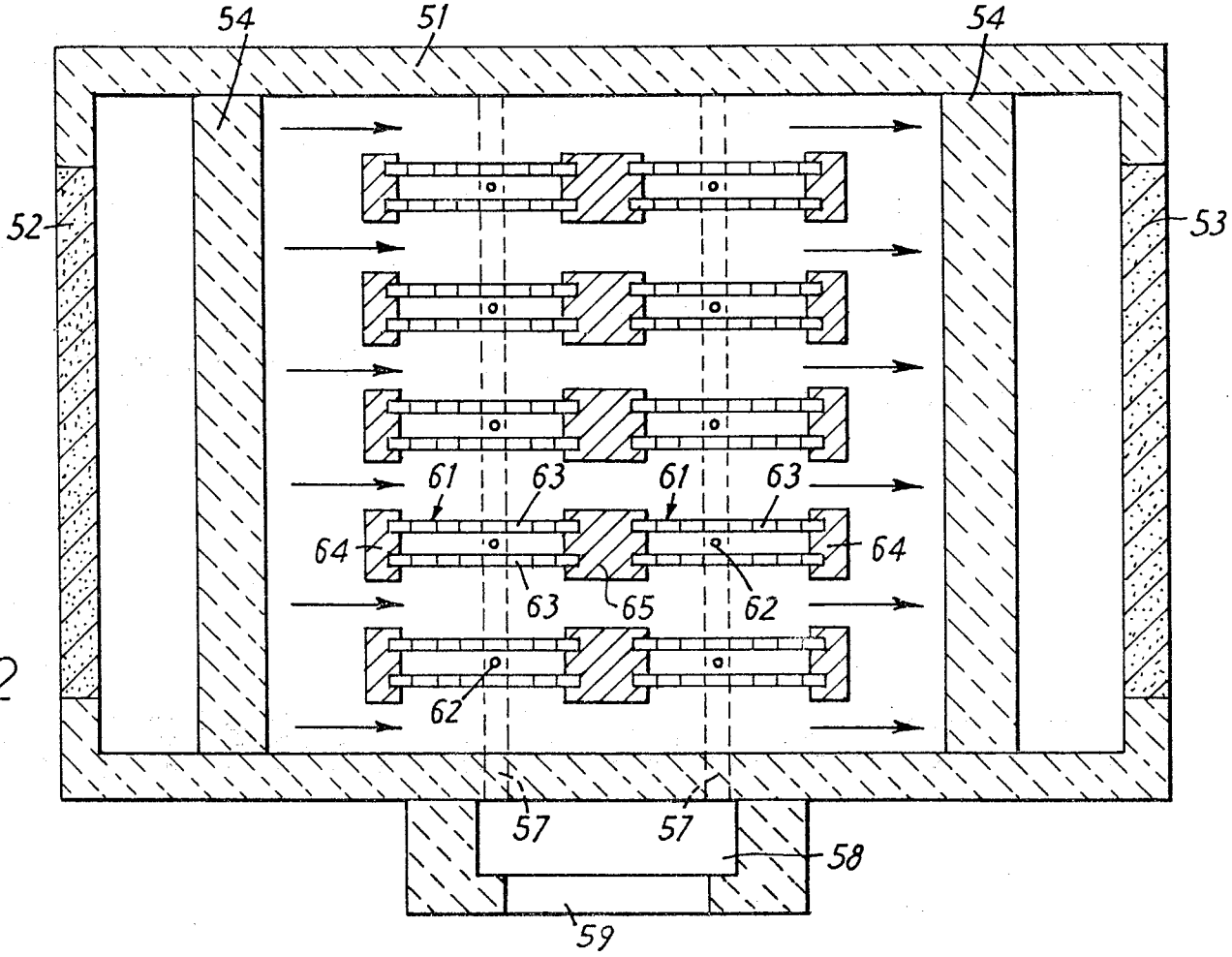
FIG. 12 is a diagrammatic plan view of the apparatus of FIG. 11.

A modified construction of refining cell is illustrated in FIGS. 11–13. In this cell there are a substantial number of refining sections arranged in parallel, so that the cell is in effect a single stage cell having a relatively low cell voltage of the order of 0.4 V. It is therefore primarily intended to be connected in series with a large number of essentially similar cells, through which a stream of relatively impure metal flows sequentially.

The cell construction of FIGS. 11–13 comprises an alumina refractory-lined shell 51, provided with inlet and outlet weir members 52, 53. The weir members 52, 53 also form anode conductors in contact with the impure aluminium stream flowing through the cell in the direction of the arrows in FIG. 11. The cell structure includes refractory partition members 54, between which a supernatant layer of electrolyte 55 is trapped above the body of impure metal 56 contained in the shell structure. The cell is enclosed by a cover (not shown) to protect the contents from atmosphere.

The floor of the shell is constituted by a massive refractory lining in which cross galleries 57 are formed for transport of refined product metal to a vertical gallery 58, having an outlet weir 59 (FIGS. 12 & 13).

Refined metal in the cross galleries 57 is in contact with a graphite cathode connector plate 60 and is in electrical contact with the refined metal cathode layers of electrolytic refining cell sections 61, via outlet channels 62.

The electrolyte refining cell sections are composed of pairs of vertically-extending alumina grille members 63, slotted into vertical solid alumina supports 64, 65, as shown in FIG. 12. The members 63 are preferably slotted into the floor as indicated in FIG. 13 and the interstices are filled with electrolyte of the character already described.

Where the vertical height of the separators is large, they are conveniently formed of separate sections in which the interstices are of different sizes, the interstices increasing progressively in size from the bottom to the top of the cell.

The space between the separator grilles 63 of each refining cell section 61 is filled with refined metal and the space between them is preferably at least 1 cm, but not more than 5 cms. The distance between the separator grilles of adjacent refining cell stages is preferably in the range of 2–10 cms to provide an anode layer of that thickness.

Although only two refining cell grille sections are shown in each row in the flow direction, it is quite practicable for the line of refining cell grille sections to be 1 meter or even more in length. The vertical height would not be more than 1 meter and more usually is of the order of 50 cms. The grilles are preferably made of honeycomb sections. The individual honeycomb sections are usually fabricated as 15 cms squares. It will be appreciated that in this construction the honeycomb sections can readily be replaced by suitable ceramic rods, preferably arranged in the vertical direction for ease of release of gas evolved at a metal/electrolyte interface.

In one application of the cell of FIGS. 11–13, the impure anode metal may be a stream of good quality commercial purity aluminium having a total impurity content of 0.15–0.2%. The refining cell is then employed to strip out a relatively small super purity fraction containing <0.05% impurity, without substantial increase of the impurity content of the commercial purity metal. In such case one or a small number of refining cells could be connected in series with an electrolytic reduction cell line and be supplied with molten metal directly from the reduction cell line.

A suitable form of honeycomb material for use in all types of refining cell construction in accordance with the invention is illustrated in FIGS. 14 and 15 and consists of relatively deep webs 71 in one direction and relatively shallow webs 72. If the webs 71 are arranged vertically or upwardly inclined so as to extend into the electrolyte the slight recesses existing in the face of the honeycomb material as a result of the lesser depth of the webs 72 provides a leakage path for the escape of gas and for replenishment of electrolyte consumed in the process. It is also convenient to form cross notches (not shown) in the webs 71 so as to provide communication between adjacent electrolyte-filled grille interstices.

The deep webs 71 preferably have a depth in the range of about 4–15 mm to maintain a low anode/cathode distance while maintaining a reasonable spacing between anode and cathode to prevent localized shorting between the anode and cathode layers. To provide the necessary mechanical strength the thickness of the webs may be equal to or even larger than the width of the interstices.

We claim:

1. A process for the electrolytic refining of impure molten metal, selected from the group consisting of aluminium and magnesium by passing current between a cathode composed of relatively pure molten metal and an anode composed of the impure molten metal through an intermediate layer of molten electrolyte for transport of ions of the selected metal characterised in that the molten electrolyte is contained within the interstices of a non-conductive grille member, said interstices having a minimum transverse dimension in the range of 0.1–1 cm.

2. A process according to claim 1 further characterised in that the electrolyte-filled grille is arranged substantially horizontal.

3. A process according to claim 1 or 2 further characterised in that the anode is composed of a stream of molten metal flowing along one side of the electrolyte-filled grille.

4. A process according to claim 3 in which the molten anode is molten impure aluminium further characterised in that a cathode layer of molten aluminium is maintained in contact with the opposite side of the grille and molten aluminium is continuously removed therefrom.

5. A process according to claim 1, further characterised in that the spacing between the molten metal cathode and molten metal anode is maintained at a distance within the range of 2–20 mm by the molten electrolyte in the grille.

6. A process according to claim 1 further characterised in that the anode is constituted by a stream of impure molten metal conveyed through a path beneath a grille composed of a plurality of parallel rods arranged to define an angle of 1°–5° to the horizontal at their upper surfaces and gas collected at the electrolyte/cathode interface is transported to the upper ends of the inclined parallel rods for the escape upwardly through a body of molten electrolyte which communicates with the electrolyte in the spaces between said rods.

7. A process according to claim 6 further characterised in that said rods are combined into a honeycomb by transverse webs of smaller depth.

8. A process according to claim 1, further characterised in that a stream of impure molten metal is passed through the anodes of a series of refining stages and is passed as a discontinuous stream through a body of molten electrolyte of relatively high resistance during transfer from the anode of one stage to the anode of the next stage, an electrical connection of relatively low resistance being maintained between the anode of one stage to the cathode of the nest stage and a voltage is maintained between the cathode of the first refining stage and the anode of the last refining stage of said series to maintain a refining voltage between the anode and cathode of each refining stage.

9. A process according to claim 1 further characterised in that the cathode is composed of a body of relatively pure aluminium confined between a pair of vertically arranged grille members having the interstices thereof filled with electrolyte.

10. Apparatus for the electrolytic refining of relatively impure molten aluminium or magnesium comprising means for containing a body of relatively impure molten metal, an electrically nonconductive grille arranged within said containing means to define a barrier between said impure metal and a body of relatively pure refined molten metal, said grille having interstices therein of a minimum transverse dimension in the range of 0.1–1 cm, said interstices being filled with fusible electrolyte and which is adapted for electrolytic transport of $Al^{+++}$ or $Mg^{++}$ ions, said grille being formed of a refractory material which is wetted by said electrolyte but not wetted by said molten metal, said apparatus including means for rendering said body of impure metal anodic and for rendering said body of refined metal cathodic, means for withdrawing product metal from said body of refined metal and means for supplementing said body of impure metal.

11. Apparatus according to claim 10 in which at least one pair of vertically arranged grilles and co-operating walls means are arranged for confining a body of refined metal within the means for containing said body of relatively impure metal.

12. Apparatus according to claim 11 further including barrier means for confining a body of molten electrolyte over the body of impure metal, said barrier means extending downwardly to a level below the upper ends of said vertically arranged grilles between which the refined metal is located.

13. Apparatus according to claim 11 further including a refractory lined non-conductive floor, passage means under said floor for outflow of product refined metal, passage means connecting said sub-floor passage means with the refined metal space between each pair of vertically arranged grilles.

14. Apparatus according to claim 11 in which each grille is in the form of a honeycomb having rectangular interstices, the webs of the honeycomb being deeper in one direction than the other, the deeper webs being arranged substantially vertically in said grille for upward escape of gas formed at a metal/electrolyte interface.

15. Apparatus according to claim 11 in which each grille is constituted by a series of spaced non-conductive refractory rods.

16. Apparatus according to any of claims 11–15 in which the grille is made from a material containing one or more of alumina, aluminium nitride, aluminium oxynitride and silicon aluminium oxynitride.

17. Apparatus for the electrolytic refining of aluminum comprising a housing, a grille dividing said housing into upper and lower sections, said grille being electrically non-conductive and having interstices therein having a minimum transverse dimension in the range of 0.1–1 cm and adapted for containing a molten electrolyte, said lower section having at least one passage beneath said grille, said passage including means at the outlet end thereof for ensuring contacts between molten metal in said passage and the surface of the grille, said upper section including means for confining a body of molten metal over said grille and an outlet to permit outflow of surplus metal from said body of molten metal and means for applying a voltage between molten metal on opposite sides of said grille.

18. Apparatus for the electrolytic refining of aluminium comprising an outer casing for a series of superposed electrolytic refining stages, each refining stage comprising a lower portion formed of electrically conductive material resistant to attack by molten aluminium, at least one groove-like passage-way in the said lower portion, an electrically non-conductive grille means arranged substantially horizontally above said lower portion, the interstices of said grille means having a minimum transverse dimension in the range of 0.1–1 cm, weir means at the outlet end of said groove-like passage-way at a level for maintaining molten metal in said passage-way in contact with the lower surface of said grille and an upper electrically non-conductive retaining means above said grille to define a molten metal-retaining cathode space, said cathode space being covered by a cover and having a weired outlet arranged to maintain contact between the molten metal in such cathode space with said cover, the cover of the cathode space in each refining stage, except the first refining stage, being constituted by the lower surface of the lower portion of the preceding refining stage, said passage-ways in said refining stages communicating with gallery means arranged within said outer casing to form a continuous serpentine passage for molten metal through said apparatus, the weired outlets from said cathode spaces communicating with separate gallery means for withdrawal of refined molten metal from said apparatus.

19. Apparatus according to claim 18 in which the grille of a refining stage is constituted by an array of separate bar-like members arranged transversely over said groove-like passageway.

20. Apparatus according to claim 19 in which such bar-like members are arranged substantially horizontal at an angle up to 5° to the horizontal, the interstices between said bar-like members communicating at their upper ends with electrolyte-filled gallery means in said housing.

21. Apparatus according to claim 18 in which each grille is in the form of a honeycomb having rectangular interstices, the webs of the honeycomb being deeper in one direction than in the other direction, the deeper webs being arranged at an inclination up to 5° to the horizontal for leading gas evolved at a metal/electrolyte interface into an electrolyte-filled gallery means in said housing, arranged at the upper end of said inclined grille.

22. Apparatus according to any of claims 17–21 in which each grille is made from a material containing one or more of alumina, aluminium nitride, aluminium oxynitride and silicon aluminium oxynitride.

* * * * *